US005960789A

United States Patent [19]

Fleming

[11] Patent Number: 5,960,789

[45] **Date of Patent: *Oct. 5, 1999**

[54] FLAMMABLE FLUID HEATING APPARATUS

[75] Inventor: John Stuart Fleming, Auckland, New Zealand

[73] Assignee: Superior Fireplace Company, Fullerton, Calif.

[ * ] Notice: This patent is subject to a terminal disclaimer.

[21] Appl. No.: 08/721,369

[22] Filed: Sep. 26, 1996

[51] Int. Cl.[6] ..... F24C 5/00

[52] U.S. Cl. ..... 126/512; 126/92 R; 126/92 B; 126/552; 431/125

[58] Field of Search ..... 126/92 R, 92 A, 126/92 AC, 85, 193, 86, 88, 512, 552, 553, 90 R; 431/125

[56] References Cited

U.S. PATENT DOCUMENTS

| | | | |
|---|---|---|---|
| 544,029 | 8/1895 | Dawson | 126/512 |
| 1,884,746 | 10/1932 | Kline et al. | 126/92 AC |
| 4,432,337 | 2/1984 | Gregory | 126/521 |
| 4,793,322 | 12/1988 | Shimek et al. | 126/193 |
| 5,054,468 | 10/1991 | Moon et al. | 126/88 |
| 5,092,313 | 3/1992 | Blackburn | 431/125 |
| 5,139,011 | 8/1992 | Moon | 126/524 |
| 5,218,953 | 6/1993 | Shimek et al. | 126/512 |
| 5,468,839 | 11/1995 | Kasulis et al. | 126/552 |
| 5,575,275 | 11/1996 | Gazaille | 126/552 |
| 5,678,534 | 10/1997 | Fleming | 126/92 R |

*Primary Examiner*—James C. Yeung
*Attorney, Agent, or Firm*—Christie, Parker & Hale, LLP

[57] ABSTRACT

This invention provides a flammable fluid fuelled heater providing a direct opening into the primary combustion chamber to provide an unobstructed view of the fire. Any circulating means such as a fan may be provided adjacent the opening so as to provide an air curtain across the opening. This may limit the flow of air through the opening to reduce overall throughput as well as reducing spillage out the opening.

In addition, the artificial log assembly in the fire may be arranged so that at least some of the logs meet collective surfaces at right angles so as to provide a visual continuity into the reflective surface and thereby provide a larger visual appearance to the fire.

19 Claims, 1 Drawing Sheet

FLAMMABLE FLUID HEATING APPARATUS

BACKGROUND (i) Field of the Invention

This invention relates to flammable fluid fuelled heaters and, in particular, although not necessarily solely, gas fuelled heaters.

(ii) Description of the Prior Art

Traditional flammable fluid fuelled heaters such as gas fuelled heaters comprise a combustion chamber into which the flammable fluid is supplied and may be provided with an exhaust into the room into which the heater is housed. Such flueless units may be provided with catalytic converters forming a secondary combustion chamber above the primary combustion chamber to reduce the emissions in the exhaust. However, in trying to provide such units with an open front wall to provide an unobstructed view of the flames in accordance with a conventional fireplace, some difficulties might arise in minimising the size of that catalytic converter due to the large open front area for the drawing of air into the primary combustion unit increasing the overall throughput of the heater. A catalytic converter of reduced size causes a obstruction to the flow of air through the heater and this may lead to spilling of emissions directly from the primary combustion out through the open front of the unit and into the room into which the unit is housed. This can cause problems with such emissions reaching levels that are either unsafe or at least outside regulatory guidelines.

Another aspect of traditional fireplaces is attempts to provide a realistic artificial log assembly in the combustion chamber. There may be a preference for a primary combustion chamber and associated artificial log assembly which attempts to provide a visually larger fire than is physically present so that the overall size of the heater unit may be minimised by still providing a relatively large apparent fire area. Such traditional technology has included the provision of a mirror behind the artificial log assembly and primary combustion chamber. However, the reflected image in the mirror does not always provide a realistic appearance if there is a visually apparent division between the real image and the reflected image.

OBJECT OF THE INVENTION

It is an object of the present invention to provide a flammable fluid fuelled heater which may overcome or minimise any one or more of these disadvantages or at least provide the public with a useful choice.

SUMMARY OF THE INVENTION

Accordingly, in a first aspect, the invention consists in a flammable fluid fuelled heater comprising:

a primary combustion chamber having an opening in at least one side thereof to provide a view of a substantial portion of the primary combustion chamber;

a flammable fluid fuel supply to said primary combustion chamber to, upon combustion, provide a substantial portion of yellow flame; and, an air circulating means to provide and/or direct a stream of air across at least a portion of said opening into said primary combustion chamber.

Accordingly, in a second aspect, the invention consists in a flammable fluid fuelled heater comprising:

a primary combustion chamber;

a flammable fluid fuelled supply to said primary combustion chamber to upon combustion, provide a substantial portion of yellow flame;

an artificial log assembly provided in said primary combustion chamber;

at least one reflective surface provided on at least one side of said primary combustion chamber to provide a reflected view of said substantially yellow flame and artificial log assembly; and, wherein said artificial log assembly provides at least one artificial log abutting said reflective surface.

Accordingly, in a third aspect the invention consists in a flammable fluid fuelled heater comprising:

a primary combustion chamber having an opening in at least one side thereof to provide a view of at least a substantial portion of said primary combustion chamber;

a flammable fluid fuel supply to said primary combustion chamber to, upon combustion, provide a substantial portion of yellow flame;

a secondary combustion chamber in communication with said primary combustion chamber containing or comprising a catalytic converter; and an air circulating means in communication with an outlet from said secondary combustion chamber so as to assist in the drawing of the products of combustion through said secondary combustion chamber.

Further aspects of this invention will become apparent to those skilled in the art upon reading the following description.

BRIEF DESCRIPTION OF THE DRAWINGS

The invention will now be described with reference to the following drawings in which.

DETAILED DESCRIPTION OF PREFERRED EMBODIMENTS

Figure 1:
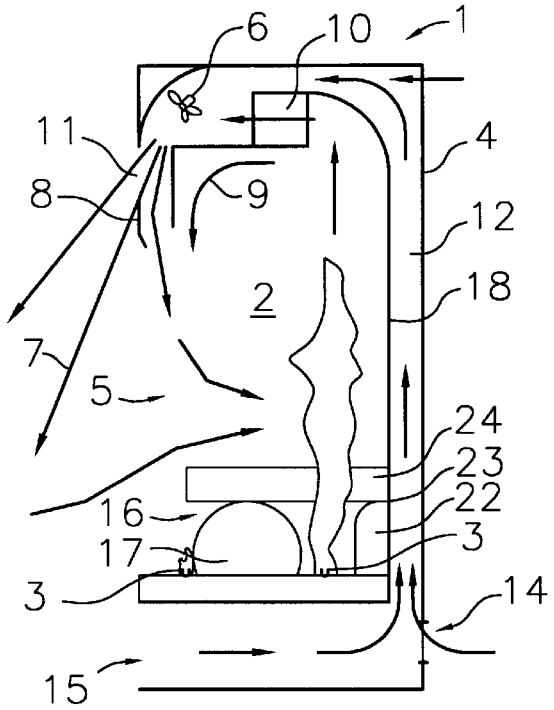
FIG. 1: shows a cross-sectional view through one possible embodiment of the apparatus; and, FIG. 2: shows a front elevational view of the apparatus of FIG. 1.
Figure 2:
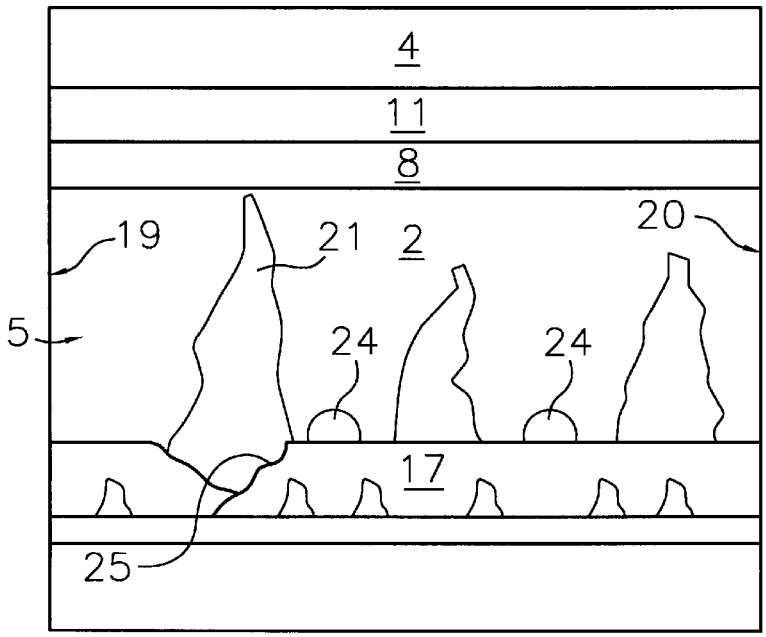

Preferred forms of the invention may be seen with reference to the figures in which a flammable fluid fuelled heater 1 having a primary combustion chamber 2 is provided. The primary combustion chamber is provided with a flammable fluid fuel supply 3 to provide a flammable fluid such as liquidified petroleum gas or compressed natural gas or other such fuels for combustion in the primary combustion chamber.

An outer housing 4 may be provided to house the apparatus and, in at least this preferred form of the invention, the primary combustion chamber 2 and outer housing 4 are provided with an opening 5 providing an unobstructed view of a substantial portion of the primary combustion chamber 2 and, in particular, that region in which combustion is occurring.

To provide a visually aesthetic fire, the fuel supply through the inlet 3 and the combustion characteristics within the primary combustion chamber 2 are such as to provide a flame having a substantially yellow appearance. To achieve this, the primary combustion chamber 2 must be depleted of oxygen content and this requires strict control over the inlet of oxygenated air into the primary combustion chamber 2 as well as the mixture of the fuel provided through the inlet 3.

The yellow flame characteristic providing a more aesthetically pleasing fireplace, also requires some incomplete combustion of the fuel in the primary combustion chamber.

The emissions from such aesthetically pleasing flames are higher than a comparable heater assembly which is configured to burn with a substantially clean blue flame. Therefore, there is some risk that spillage of the products of the primary combustion through the open front 5 may lead to the room in which the heater is housed, having raised levels of carbon monoxide and carbon dioxide.

Although it is perhaps possible to reduce such spillage through increasing the throughput through the apparatus 1 such that the large opening 5 into the primary combustion chamber 2 has sufficient draught to inhibit the exiting of the products of primary combustion through that opening, such a throughput leads to difficulty in achieving the yellow flames while still operating efficiently. Further, a large throughput requires a larger catalytic converter to accommodate the air flow. Also this increased throughput will have a cooling effect on a catalyst which increases the difficulty in achieving light off temperature.

The present invention provides an air circulating means 6 which may be of any convenient type to create an airstream or draught and, in this preferred form, is provided as a fan. The circulating means 6 is provided to create a stream of air 7 which projects across the opening 5. Such an airstream both reduces the effective size of the opening 5 for air inlet which improves the ability to deplete the oxygen within the primary combustion chamber as well as inhibiting the spillage of the products of combustion adjacent the upper edge of the opening 5. This is particularly the case when the airstream 7 is provided to project downwardly from an upper edge of the opening 5 as indicated in FIG. 1.

In addition, this form of the invention also provides a deflector 8 running across the airstream to deflect some of the airstream back into the primary combustion chamber 2 which further helps to reduce spillage of products from the primary combustion as designated by arrow 9.

Again in the preferred form, the heating apparatus 1 may be provided as a flueless unit as indicated or, a unit in which at least a portion of the exhaust from the heater is directed into the room in which the heater 1 is housed. To improve the standard of those emissions, a secondary combustion chamber 10 which includes or comprises a catalytic converter may be provided. In this manner, the products of primary combustion may be drawn through the catalytic converter 10 and through an exhaust port 11 into the room in which the heater is housed and be relatively low in uncombusted hydrocarbons such as carbon monoxide and other pollutants. With the air inlet being provided at least partially by the open front 5, not only are the products of the primary combustion chamber further combusted to improve the exhaust quality but other odours in the room such as cooking odours may be removed through the catalytic converter 10.

Catalytic converters for such apparatus are relatively expensive and, therefore, the size of the catalytic converter required can become an important factor in providing a cost efficient heater. The minimisation of the size of the catalytic converter will also decrease the throughput capable from the catalytic converter 10. It is normal in such units for the catalytic converter 10 to provide the greatest restriction to flow in the entire apparatus and this tends to increase any potential problems with spillage of products directly from the primary combustion chamber.

In the present invention, an air duct 12 may be provided in communication with the secondary combustion chamber or catalytic converter 10 and the exhaust port 11 so as to create an airstream across the outlet from the secondary combustion chamber 10. The duct 12 is also in communication with the air circulating means 6 to create the airstream and the flow of this airstream across the exit from the catalytic converter and provides the draft through the catalytic converter to improve overall throughput. Not only may such an arrangement improve the performance of the catalytic converter but also reduce the restriction that the converter provides in the apparatus and therefore decreasing the quantity of circulating products from the primary combustion as indicated by arrow 9.

The ducting 12 may also provide a number of other functions such as providing a fresh cooler airstream within the housing 4 to reduce the temperatures of the outer panels of the overall apparatus 1 forming the housing 4. Furthermore, should it be desired, the housing 4 and ducting 12 may be provided with an inlet 14 for connection to a vent to an area external to the room in which the heater is housed such as to the outside of a building. Such an inlet 14 allows ventilation of the room in conjunction with the heater apparatus 1.

Alternatively or additionally, the inlet for the ducting 12 may be in the base of the heater below the primary combustion chamber 2 such as the inlet 15.

The air circulating means 6 may be provided in a number of forms and also in a number of positions. In the preferred apparatus as shown in FIG. 1, the air circulating means 6 may be provided anywhere on communication with the ducting 12 to direct the airstream as suggested. This includes the positioning in a region beneath the primary combustion chamber 2 such as between the inlets 15 and 14.

It should also be noted that the inlet 14 for connection to an external source of air may be provided as an adjustable inlet so that the proportion of air drawn from an external source and the proportion of air drawn through an inlet such as inlet 15 from within the room can be balanced. This adjustment may be through the form of a baffle plate or similar which can adjust the size of the opening 14. This adjustment may be provided during manufacture and set to a suitable level or allow some manual or controlled adjustment.

In addition or alternatively to the baffle plate or similar control over the vent, the air circulating means 6 may be provided in the form of a variable speed fan to increase draft through the ducting 12 to increase the drawing of air from the outside. Of course, in a preferred form, it may be desirable to provide separate air circulating means 6 with at least one of these air circulating means being primarily to draw air through the inlet 14 from an external source. This additional air circulating means or other form of control over the inlet 14 may be linked to a heater control system (not shown) to allow variation in the inlet air.

In some territories, regulatory requirements set down levels for ventilation in a room in which such a heater is housed. The air drawn through the inlet 14 from an external source may be measured through the inclusion of a suitable air flow sensor to ensure that the adequate ventilation levels are being met. This provides a verifiable control over the air coming into the room in which the heater is housed which will force air from within that room out through any available exit. Should the inlet air fall below a minimum limit, the heater can attempt to compensate by increasing the fan speed, size of the inlet vent or, if necessary, turn the unit off rather than continue to operate below a minimum level. This may involve a link into the gas supply to shut off the unit if the ventilation requirements are not being met.

The control over this inlet air from an external source can also provide other benefits. In a controlled heater which may involve a thermostatic control or similar, the quantity of gas being supplied to the unit may be adjusted to control the heat output from the heater. For example, a heating appliance may have a maximum capacity of 25 MJ. Once the thermostatic or other controller suggests that the heater should reduce its output, this may be controlled through control of the quantity of gas supplied into the unit. However, as this gas supply continues to reduce, the flame height on the unit may also be effected. Once the gas consumption falls below, for example, half its maximum level, it may be decided that the flame height is now insufficient to provide a visually aesthetic appearance. In circumstances where gas consumption is of prime importance, such a reduction in flame height may be of no great concern. However, if the visual appearance of the fire is considered more important, it may be desirable to make the unit operate less efficiently so as to increase the flame height.

One manner of achieving this can be by again increasing the air flow from outside of the room in which the heater is housed. This increase of inlet air will effectively dump heated air within the room out through any available means. This dumping of heated air within the room allows the unit to continue to operate with a higher gas flow and greater heat output and hence higher visible flame.

Of course, control of the unit may also alter air flow through the unit and gas consumption as other variables related to the efficiency of the heater, heat output and flame height.

Flammable fluid fuelled heaters 1 such as shown in the present invention are also often provided with an artificial log assembly within the primary combustion chamber 2 so as to give the appearance of a wood fire place. Any attempts to minimise the size of the overall heater 1 lead to some compromise being made in the size of the fire and the artificial log assembly such as the artificial log assembly 16 comprising artificial logs 17.

In an attempt to provide a larger visual appearance to the fire, at least one portion of the primary combustion chamber 2 may be provided with a reflective surface such as the back wall 18. In this preferred form of the invention, the primary combustion chamber 2 is also provided with side walls 19 and 20 which are also provided as reflective surfaces to give a reflected image of the log assembly 16 and flames 21.

The problem with such reflective surfaces is often the appearance of two separate or distinct fires being the artificial log assembly 16 and flames 21 and the reflected image of both. There is an apparent discontinuity between the two images. In the present preferred embodiment, artificial logs 17 are provided to abut the reflective surfaces to provide an apparent continuity of the log into the reflective surface.

Referring to the rear base log 22 of the assembly 16, it can be seen that the upper edge 23 of this log is provided to abut the reflective back wall 18. As such the base log 22 is provided as a half round log in the artificial log assembly 16. Upon being abutted to the reflective surface 18, the reflective surface 18 provides a continuity to this log to give the appearance of a full round log when the real and reflected images of the base log 22 are varied. The base log 22 is provided having a longitudinal axis substantially parallel to the rear wall 18.

Similarly, additional logs 24 may be provided which abut the rear wall 18 such that the longitudinal axis of the logs 24 is substantially transverse to the plane of the rear wall 18. In this manner, the length of the log 24 appears to be extended in the reflective image and again providing some continuity into the reflected image.

In this preferred form where side walls 19 and 20 are also provided with reflective surfaces, the logs abutting those surfaces such as the front log 17 abut the side wall 20 substantially perpendicular to the plane of that reflective surface to provide some continuity into the reflective surface.

In this preferred form, at least a portion of the flames 21 will be provided intermediate of the logs perpendicular to the rear wall 18 such as logs 24 and the side walls 19 and 20 so as not to provide a gap in the flames in the primary combustion chamber and shown in the reflective surface of the side walls 19 and 20.

Another feature of the artificial log assembly 16 in this preferred form is that the logs such as log 17 across the heater 1 may be provided with a discontinuity such as a burnt out portion 25. Such artificial log assemblies are often constructed from ceramic fibre logs and these may have substantial variations in shrinkage in production. Therefore, the provision of logs across the heating apparatus 1 to accurately abut against both the side walls 19 and 20 can be exceedingly difficult. The provision of the burnt out portion 25 allows the transverse log such as log 17 to be provided with an apparent naturally occurring reason for not extending entirely across the fire and creating the potential for gaps against the side walls 19 and 20 should a tight abutment against both be unable to be achieved.

The provision of the reflected extension of the logs 17,24, etc., may lead to the selection of logs having diameters larger than chosen for a normal assembly. The diameters are chosen in keeping with those that appear natural for a fire as provided by both the real and reflective images combined and in keeping with the greater apparent length of the logs.

Thus it can be seen that at least the preferred form of this invention provides a heating apparatus 1 which may provide an open front 5 and yet provide some inhibition to the spillage of gases from the primary combustion chamber 2.

In addition, the heater 1 provides an artificial log assembly having reflective surfaces around the perimeter of the primary combustion chamber and the artificial log assembly having logs abutting the reflective surfaces so as to provide the appearance of continuity into the reflective surfaces.

Where in the foregoing description reference has been made to specific components or integers of the invention having equivalents then such equivalents are herein incorporated as if individually set forth.

Although this invention has been described by way of example with reference to possible embodiments thereof it is to be understood that modifications or improvements may be made thereto without departing from the scope of the invention.

I claim:

1. A flammable fluid fueled heater comprising:

a primary combustion chamber having an opening in at least one side thereof for providing a view of a substantial portion of the primary combustion chamber;

a flammable fluid fuel supply to said primary combustion chamber to, upon combustion, provide a substantial portion of yellow flame, wherein upon combustion exhaust gases are generated;

a secondary combustion chamber in communication with the primary combustion chamber for receiving exhaust gases generated in the primary combustion chamber, the secondary combustion chamber comprising a catalytic converter;

an exhaust port in communication with the secondary combustion chamber for redirecting at least a portion of the exhaust gases received into the secondary combustion chamber into a room where the heater is located; and an air circulating means for providing a stream of air across at least a portion of said opening.

2. A flammable fluid fueled heater as claimed in claim 1 wherein said air circulating means comprising at least one fan.

3. A flammable fluid fueled heater as claimed in claim 1 or claim 2 wherein said stream of air is directed over a portion of said opening substantially from an upper edge of said opening.

4. A flammable fluid fueled heater as claimed in claim 1 wherein said apparatus includes a deflector coupled to the exhaust port to deflect at least a portion of said airstream into said opening and into said primary combustion chamber.

5. A flammable fluid fueled heater as claimed in claim 1 wherein said air circulating means provides a stream of air across an outlet formed between said secondary combustion chamber and said exhaust port so as to assist in the drawing of the products of combustion through said secondary combustion chamber.

6. A flammable fluid fueled heater as claimed in claim 5 further comprising a duct for receiving air from a source external to the heater and directing said air toward the exhaust ports, wherein said air circulating means draws air through said duct.

7. A flammable fluid fueled heater as claimed in claim 6 wherein said duct includes an inlet connectable to a source of air externally to the room in which the heater is housed.

8. A flammable fluid fueled heater is claimed in claim 7 wherein air drawn through said inlet connectable to a source of air external to the room in which the heater is housed is adjustable.

9. A flammable fluid fueled heater comprising:

a primary combustion chamber having an opening in at least on side thereof to provide a view of at least a substantial portion of said primary combustion chamber;

a flammable fluid fuel supply to said primary combustion chamber to, upon combustion, provide a substantial portion of yellow flame and generate products of combustion;

a secondary combustion chamber in communication with the primary combustion chamber for receiving products of combustion from the primary combustion chamber said secondary combustion chamber comprising a catalytic converter;

an air circulating means for assisting in the drawing of the products of combustion through said secondary combustion chamber; and an exhaust port in communication with the secondary combustion chamber for receiving the products of combustion and exhausting at least a portion of said products into a room where the heater is located.

10. A flammable fluid fueled heater as claimed in claim 9 wherein said air circulating means draws the products of combustion from said catalytic converter.

11. A flammable fluid fueled heater as claimed in claim 9 further comprising a duct receiving air from a source external to the heater, wherein said exhaust port receives air from the duct and the products of combustion, and wherein said air circulating means further draws air from said duct.

12. A flammable fluid fueled heater as claimed in claim 11 further comprising means for adjusting the volume of air being received by said duct.

13. A flammable fluid fueled heater as claimed in claims 9, 10, 11 or 12 wherein said air circulating means additionally provides a stream of air across at least a portion of said opening.

14. A flammable fluid fueled heater as claimed in claims 9, 10, 11 or 12 wherein said air circulating means comprises at least one fan.

15. A flammable fluid fueled heater comprising:

a primary combustion chamber;

a flammable fluid fueled supply to said primary combustion chamber to upon combustion, provide a substantial portion of a yellow flame and generate products of combustion;

an opening formed on the primary combustion chamber for exhausting the products of combustion;

an artificial log assembly provided in said primary combustion chamber;

at least one reflective surface provided on at least one side of said primary combustion chamber to provide a reflected view of said substantially yellow flame and artificial log assembly; and wherein said artificial log assembly provides at least one artificial log abutting said reflective surface, said artificial log having a longitudinal axis substantially parallel to said reflective surface and having a longitudinal upper edge abutting said reflective surface such that the artificial log and the apparent reflection of said log creates the appearance of a full round log.

16. A flammable fluid fueled heater as claimed in claim 15 wherein said artificial log assembly includes at least one artificial log abutting said reflective surface and having a longitudinal axis substantially transverse to the plane of said reflective surface.

17. A flammable fluid fueled heater as claimed in claim 16 wherein said reflective surface is provided on the rear wall and side walls of said primary combustion chamber.

18. A flammable fluid fueled heater comprising:

a housing having an opening;

a primary combustion chamber within the housing, the primary combustion chamber having an opening in at least one side thereof aligned with the housing opening providing a view of the combustion chamber from a location external to the housing;

a flammable fluid fuel supply to said primary combustion chamber to, upon combustion, provide a substantially yellow flame;

a secondary combustion chamber comprising, an intake in communication with the primary combustion chamber for receiving products of combustion from the primary combustion chamber, a catalytic converter, and an exhaust for exhausting the products of combustion;

a duct between the housing and the primary combustion chamber for receiving air from a source external to the heater, the duct providing a flow of air over the exhaust; and an air circulating means for increasing the circulation of air through said duct for creating an air stream across the secondary combustion chamber exhaust for increasing the throughput through the catalytic converter.

19. A flammable fluid fueled heater comprising:

a primary combustion chamber;

a flammable fluid fueled supply to said primary combustion chamber to upon combustion, provide a substantial portion of a yellow flame and generate products of combustion;

an opening formed on the primary combustion chamber for exhausting the products of combustion;

an artificial log assembly provided in said primary combustion chamber;

at least one reflective surface provided on at least one side of said primary combustion chamber to provide a reflected view of said substantially yellow flame and artificial log assembly; and wherein said artificial log assembly provides at least one artificial log abutting said reflective surface said artificial log abutting said reflective surface and having a longitudinal axis substantially transverse to the plane of said reflective surface.

* * * * *